United States Patent [19]

Wohrle

[11] 4,169,425

[45] Oct. 2, 1979

[54] APPARATUS FOR REMOVING THE SURPLUS OF COATING COMPOUND IN PAPER COATING MACHINES

[75] Inventor: Albert Wohrle, Giengen, Fed. Rep. of Germany

[73] Assignee: J. M. Voith GmbH, Heidenheim, Fed. Rep. of Germany

[21] Appl. No.: 747,775

[22] Filed: Dec. 6, 1976

[30] Foreign Application Priority Data

Dec. 11, 1975 [DE] Fed. Rep. of Germany ..... 2555669

[51] Int. Cl.[2] ..... B05C 11/04

[52] U.S. Cl. ..... 118/665; 118/126

[58] Field of Search ..... 118/123, 126, 261, 413, 118/8, 4; 101/365; 15/256.51

[56] References Cited

U.S. PATENT DOCUMENTS

| | | | |
|---|---|---|---|
| 3,113,890 | 12/1963 | Johnson et al. | 118/126 |
| 3,131,092 | 4/1964 | Coghill | 118/413 |
| 3,143,438 | 8/1964 | Campbell | 118/126 X |
| 3,229,662 | 1/1966 | Means | 118/126 |
| 3,683,851 | 8/1972 | Nolden | 118/126 |
| 3,722,465 | 3/1973 | Krautzberger | 118/123 |
| 3,748,686 | 7/1973 | Winterburn et al. | 15/256.51 |
| 3,783,781 | 1/1974 | Grommek | 15/256.51 X |
| 3,803,665 | 4/1974 | Winterburn et al. | 15/256.51 |
| 3,855,927 | 12/1974 | Simeth | 118/261 X |
| 3,995,478 | 12/1976 | Wilhelm, Jr. | 118/8 X |

*Primary Examiner*—John P. McIntosh
*Attorney, Agent, or Firm*—Peter K. Kontler

[57] ABSTRACT

Apparatus for removing the surplus of coating composition at the exposed side of a running paper web has a stationary support for a deformable doctor blade the edge portion or one side of which extends transversely of the path for and contacts the exposed side of the running web, a pivotable or reciprocable rigid beam which is mounted on the support and is urged toward the blade by one or more inflated flexible hoses, and a profile adjusting unit which is mounted on the beam and can be adjusted to deform selected portions of the blade in dependency on the desired profile of the exposed side of the web. The beam compensates for eventual variations of the bias of the hose, as considered transversely of the path. The pressure of fluid which is confined in the hose can be regulated in dependency on deviations of measured weight of coating composition from a desired weight. The regulating system utilizes a computer which compares first signals representing the measured weight with a reference signal and causes a transducer and a pneumatic amplifier to change the pressure of fluid whenever the intensity of first signals deviates from intensity of the second signal.

36 Claims, 7 Drawing Figures

APPARATUS FOR REMOVING THE SURPLUS OF COATING COMPOUND IN PAPER COATING MACHINES

BACKGROUND OF THE INVENTION

The present invention relates to coating machines for paper or the like, and more particularly to improvements in apparatus for removing surplus coating compound from the coated side or surface of a web or sheet of paper, cardboard or the like. Still more particularly, the invention relates to improvements in the construction, mounting and adjustment of doctor blades which are used in such apparatus to remove the surplus of coating compound from a running web or sheet of coated material.

Many types of paper or cardboard must be provided with relatively thick or heavy layers of a coating compound. For example, it is not out of the ordinary if the weight of the coat on a web of paper or cardboard is in the range of between 15 and 25 grams per square meter. The application of such heavy coats presents many problems; as a rule, the operation involves repeated coating of paper or cardboard with suitable compound, e.g., a mixture of white mineral matter, adhesive and dyes. When the weight of the coat exceeds a threshold value, normally about 15 grams per square meter, the coating machine must embody an apparatus which effects a correction of profile across the full width of the running paper or cardboard web. This insures that the coated material exhibits a smooth surface and can be properly wound to form satisfactory rolls.

German Pat. No. 2,012,598 discloses an apparatus for removal of surplus coating compound from coated paper wherein the surplus removing means comprises a doctor blade extending across the full width of the running paper web and a gas-filled hose which biases the blade against the coated surface. The force with which the blade bears against the running web can be regulated by changing the pressure of compressed gas (normally air) in the interior of the hose. The hose is mounted on a strip-shaped support and bears directly against the doctor blade. The support consists of several sections which are movable relative to each other. This enables the attendants to control the force with which the corresponding portions of the blade bear against the coated surface and to thus determine the exact profile of the coated surface.

The patented apparatus cannot insure the formation of a high-quality coat because the wall thickness of a relatively long hose is not uniform from the one to the other end thereof. Thus, when the pressure of fluid in the interior of the hose increases, the expansion of thin-walled portions exceeds the expansion of thicker portions with the result that the profile of the coated surface deviates from an optimum profile. In order to compensate for non-uniformity of wall thickness of the hose, the patent proposes the utilization of a springy insert which is made of sheet metal and is installed intermediate the blade and the hose. The insert is capable of compensating for some deviations of wall thickness of the hose from the optimum thickness; however, the compensation is insufficient to insure that the profile of the coat surface will not deviate appreciably from a desired optimum profile. Furthermore, internal stresses which develop in the material of the springy insert reduce its effectiveness.

The undesirable effect of variations in wall thickness of the hose is more pronounced when the pressure in the interior of the hose rises. Therefore, the aforementioned strip-shaped support must be assembled of a large number of relatively short sections in order to enable the attendants to compensate for departure of certain portions of the doctor blade from an optimum position. This contributes to complexity of the patented surplus removing apparatus. Also, the versatility of the patented apparatus is unsatisfactory because it cannot be readily converted from operation with a slightly bent doctor blade (the edge of the blade bears against the coated surface) to operation with a pronounced bending of the blade (whereby a side of the blade bears against the coated surface) or vice versa.

OBJECTS AND SUMMARY OF THE INVENTION

An object of the invention is to provide a novel and improved surplus removing apparatus whose versatility greatly exceeds the versatility of conventional apparatus, which can be used for removal of the surplus of coating compound from surfaces whereon the weight of coat per unit area varies within an extremely wide range (e.g., between 5 and 30 grams per square meter), and which is less prone to contamination than heretofore known apparatus.

Another object of the invention is to provide a novel and improved arrangement of parts which maintain all portions of an elongated doctor blade in an optimum position with respect to the coated surface of a running web of paper, cardboard or the like and which allow for predictable and accurately reproducible adjustment of the pressure with which the edge or a side of the blade bears against the coated surface.

A further object of the invention is to provide a surplus removing apparatus which can be readily installed in or combined with existing coating machines as a superior substitute for conventional surplus removing apparatus.

An additional object of the invention is to provide the apparatus with novel and improved means for biasing the doctor blade against the coated surface and with novel and improved means for automatically changing the bias upon or the profile of the edge of the blade when the quality of coat on the running web does not meet the required norm.

An ancillary object of the invention is to provide a novel and improved arrangement for adjusting the means for biasing the doctor blade in a surplus removing apparatus of the above outlined character.

The apparatus of the present invention is utilized to remove the surplus of coating composition from the coated side of a running web which consists of paper or the like. The apparatus comprises a driven rotary drum or analogous means for advancing the web along a predetermined path wherein the coated side of the web is exposed, a deformable doctor blade which is adjacent to the coated side of the web and extends transversely of the path, means for adjusting the profile of the blade including a rod-like element made of rubber or a leaf spring which determines the profile of and is in direct contact with the blade, and means for biasing the blade against the exposed side of the running web through the medium of the profile adjusting means.

The biasing means preferably comprises an elongated beam or an analogous rigid member extending transversely of the path for the web and one or more inflatable flexible hoses or other suitable means for urging the beam toward the path. The beam is movable sideways toward and away from the path. The profile adjusting means is preferably secured to and shares all movements of the beam, and the apparatus preferably further comprises a stationary support for the beam and doctor blade as well as one or more leaf springs, tongue-and-groove connections or analogous means for restricting the beam to pivotal or translatory movement relative to the support toward or away from the doctor blade.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
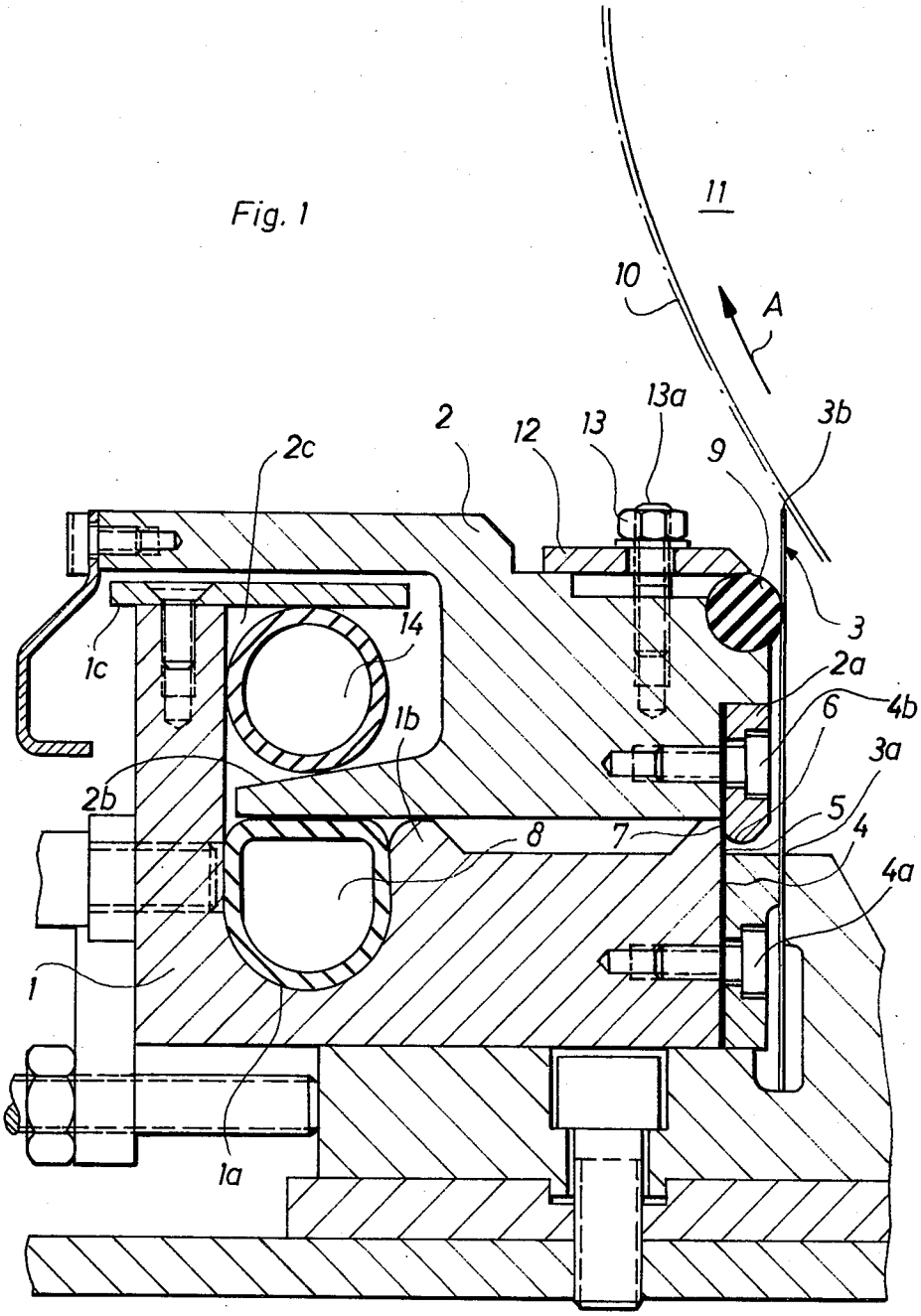
FIG. 1 is a transverse vertical sectional view of an apparatus which embodies one form of the invention.

The apparatus which is shown in FIG. 1 comprises a stationary composite support 1 for an elongated rigid pivotable member 2 here shown as a beam, a doctor blade 3, and an elongated inflatable fluid-containing receptacle or hose 8 which is installed in a recess 1*a* of the support 1 and is in contact with the underside of the beam 2. The beam 2 extends in parallelism with the axis of a horizontal roll or drum 11 which advances a coated web or sheet 10 of paper along a predetermined path. The direction in which the drum 11 is driven to move successive increments of the coat at the exposed side of the web 10 past the doctor blade 3 is indicated by an arrow A. The means for restricting the beam 2 to pivotal movement relative to the support 1 about an axis which is parallel to the axis of the drum 11 comprises a leaf spring 4 secured to the members 1 and 2 by bolts 4*a*, 4*b* or by analogous fasteners. The spring is substantially parallel to the blade 3. A stop 1*b* at the upper side of the support 1 determines the initial or starting position of the beam 2 (such position is shown in FIG. 1). When the hose 8 is expanded in response to admission of a compressed gaseous fluid into its interior, it bears against that (rear) portion of the beam 2 which is remote from the blade 3 and causes the beam to pivot clockwise, as viewed in FIG. 1. The leaf spring 4 is thereby caused to flex about a convex surface 6 forming part of the front portion of the beam 2 or of a strip 2*a* which bears against the upper portion of the spring 4. The region where the spring 4 is flexed in response to pivoting of the beam 2 relative to the support 1 is indicated at 5; this region is located between the front and rear portions of the beam. The convex surface 6 is located opposite an edge face 7 of the support 1, with the median portion of the spring 4 therebetween. The spring 4 can be said to constitute a simple hinge whose leaves are respectively affixed to the support 1 and beam 2 and the upper leaf of which is pivotable relative to the lower leaf about a predetermined axis which is defined by the convex surface 6 and edge face 7.

The lower portion of the doctor blade 3 is anchored in the support 1 in front of the spring 4, and the upper portion of the blade extends toward the exposed surface of the web 10 on the drum 11. When the beam 2 is pivoted clockwise, as viewed in FIG. 1, it causes a profile determining element 9, here shown as a round rod-like rubber insert, to bear directly against the upper portion of the blade 3 and to flex the blade toward the exposed surface of the web 10. The blade 3 is then flexed at 3*a*, i.e., at the locus where it extends from the upper side of the support 1. The force with which the profile determining element or insert 9 bears against the left-hand side of the upper portion of the doctor blade 3 depends on the selected pressure of fluid in the hose 8. The insert 9 forms part of a means for adjusting or selecting the profile of the edge portion 3*b* of the blade 3, and the parts 2 and 8 constitute a means for biasing the profile adjusting means against the doctor blade. The edge portion 3*b* strips the surplus of coating off the exposed side of the running web 10, and the removed surplus is collected in a region below the drum 11 in a manner not shown in the drawing. At the same time, the edge portion 3*b* smooths and equalizes the coating at the exposed side of the web 10.

The profile adjusting means further comprises a strip-shaped deforming member 12 which is secured to the beam 2 by a row of bolts 13*a* and nuts 13 or analogous fasteners and whose right-hand portion bears against the top portion of the insert 9. The left-hand portion of the deforming member 12 abuts against the top surface of the beam 2. By changing the axial positions of nuts 13 relative to the respective bolts 13*a*, the attendants can change the extent to which the insert 9 is deformed and hence the profile of the edge portion 3*b*. The nuts 13 can be adjusted independently of each other so as to change the extent of deformation of adjacent portions of the insert 9 and hence the position of the adjacent sections of the edge portion 3*b*. If desired, the deforming member 12 may consist of several discrete components which are disposed end-to-end in parallelism with the axis of the drum 11 and each of which can be pivoted by one or more nuts 13. A flattening of the insert 9 in response to clockwise pivoting of the deforming member 12 causes the right-hand portion of the insert 9 to bulge in a direction to the right, as viewed in FIG. 1, and to thereby deform the intermediate part of the exposed portion of the blade 3 because the lower portion of the blade is anchored in the support 1 and the edge portion 3*b* bears against the coating at the exposed side of the web 10. As mentioned above, the adjusting means 9, 12, 13, 13*a* allows for simultaneous flexing of the entire blade 3 to the same extent or for flexing of selected portions or sections of the blade, depending on the desired position of edge portion 3*b* with respect to the path of movement of the web 10. The profile of the blade 3 (i.e., the position of its scraping and smoothing edge portion 3*b* relative to the path for the web 10) is independent of the extent to which the fluid in the hose 8 is compressed.

The apparatus of FIG. 1 further comprises a second inflatable fluid-containing receptacle or hose 14 which reacts against a plate 1*c* affixed to or forming part of the support 1 and bears against a surface 2*b* in a recess 2*c* machined into the rear side of the beam 2. Thus, the hose 14 tends to pivot the beam 2 counterclockwise, as viewed in FIG. 1, and to maintain the underside of the beam in its starting position (of abutment with the stop 1*a*). The hose 14 insures that, when the apparatus is in use, the position of the exposed portion of doctor blade 3 remains unchanged as long as the pressure of fluid in the hose 8 remains unchanged. This is desirable and advantageous, especially when the nature of treatment to which the coating of the web 10 is to be subjected is such that the edge portion 3*b* should exert a relatively low pressure against the exposed side of the web. Moreover, the attendants know that, whenever the pressure of fluid in the hose 8 is less than the pressure of fluid in the hose 14, the beam 2 invariably dwells in the starting position of FIG. 1. The difference between the fluid pressures in the hoses 8 and 14 determines the force with which the beam 2 biases the insert 9 of the profile adjusting means 9, 12, 13, 13*a* against the blade 3.

An important advantage of the improved apparatus is that the profile adjusting means 9, 12, 13, 13*a* includes a part 9 which is in direct engagement with the doctor blade 3, and that the biasing means 2, 8, 14 applies pressure against the blade through the medium of the profile adjusting means. In other words, a feature of the invention resides in a novel arrangement of parts which insures that such parts act upon the blade in a sequence which guarantees an optimum regulation of thickness and quality of coat at the exposed side of the running web. The doctor blade 3 is the last part of the chain of parts which influence the thickness and quality of the coat; the blade 3 is preceded by the profile adjusting means 9, 12, 13, 13*c* which, in turn, precedes the rigid beam 2. The latter precedes the inflatable hose 8 of the biasing means. This brings about the following advantages:

Adjustments of the biasing means do not affect the selected profile of the doctor blade 3, regardless of whether the fluid which fills the hose 8 is a liquid or a gas and/or whether or not the wall thickness of the hose 8 is constant. Any variations of force which the hose 8 exerts against the beam 2 (as considered in the axial direction of the drum 11) are compensated for by the fact that the beam is a rigid body. Each and every portion of the beam 2 pivots to the same extent whenever the pressure of fluid in the hose 8 changes so that uneven expansion or contraction of the hose 8 cannot influence the extent to which the entire profile adjusting means moves toward or away from the doctor blade. Moreover, the rigid beam prevents undesirable shifting of portions of the profile adjusting means (e.g., of the components of a composite deforming member 12) relative to each other. In other words, such components will be shifted relative to each other only and alone when an attendant decides to rotate one or more nuts 13.

Secondly, the adjustability of profile adjusting means independently of adjustment of the biasing means, or vice versa, renders it possible to employ the improved surplus removing apparatus in machines wherein the exposed side of a running web is to be contacted by the edge portion or by one side of the doctor blade.

Furthermore, the adjustment of profile adjusting means and/or biasing means is relatively simple and can be completed within short intervals of time. The thickness and/or quality of the coat can be selected and maintained with a high degree of accuracy and reproducibility, regardless of the thickness of the coat prior to removal of the surplus. Experiments with the improved apparatus indicate that the quality of the coat subsequent to removal of surplus coating composition is highly satisfactory (not only as regards the uniformity of weight per unit area but also as concerns the smoothness of the final coat) even if the selected weight is as low as five or as high as thirty grams per square meter. Moreover, a very thick coat can be applied in a single operation because such thick coat can be readily equalized, and the surplus coating composition removed, by resorting to the improved apparatus. The apparatus can be installed in existing coating machines as a superior substitute for conventional surplus removing apparatus, not only due to its ability to insure the formation of a coat having a predictable thickness and quality but also because it is less sensitive to contaminants.

A further advantage of the improved apparatus is that its profile adjusting means consists of parts which are assembled without any play. This also contributes to accuracy and reproducibility of blade adjustment.

Figure 2A:
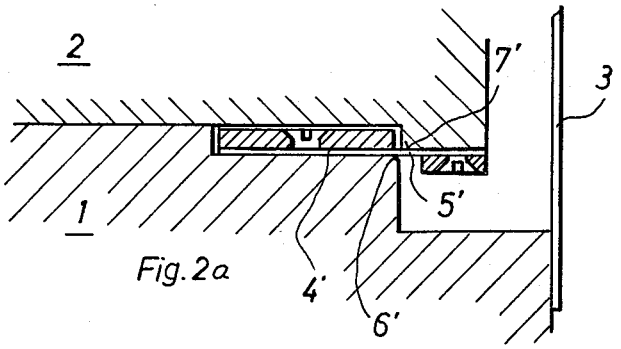
FIG. 2*a* is a fragmentary transverse vertical sectional view of a modified apparatus.

FIG. 2*a* shows a portion of a second apparatus. The leaf spring 4' is mounted in a slightly different way, namely in such a manner that its plane is substantially normal to the plane of the doctor blade 3. In other words, the spring 4' is located between the underside of the beam 2 and the upper side of the support 1. The convex surface 6' is provided on the support 1 and the edge face 7' is provided on the beam 2. The region where the leaf spring 4' is flexed in response to pivoting of the beam 2 relative to the support 1 is shown at 5'. In all other respects, the apparatus of FIG. 1 is identical with or analogous to the apparatus of FIG. 1.

Figure 2B:
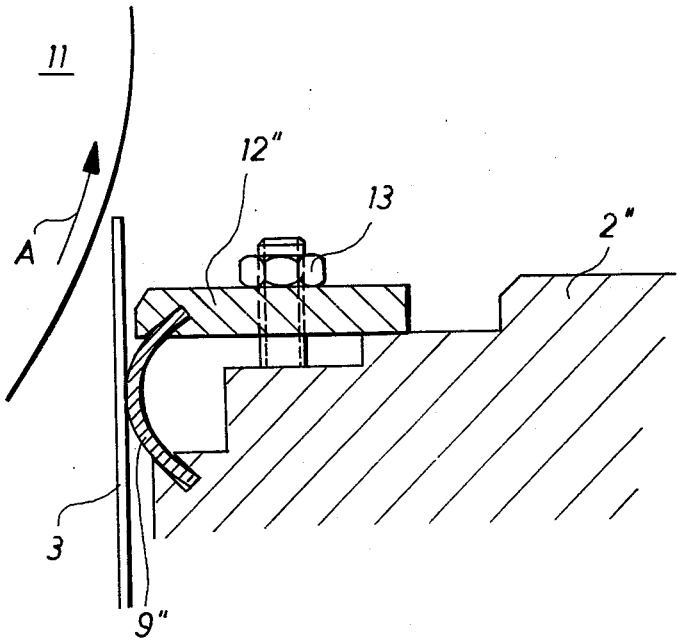
FIG. 2*b* is a similar fragmentary transverse vertical sectional view of a third apparatus.

The apparatus of FIG. 2*b* employs a profile determining element or insert 9'' in the form of an elastic strip the upper marginal portion of which is recessed into the deforming member 12'' (corresponding to the member 12 of FIG. 1) and the lower marginal portion of which is recessed into the beam 2''. The convex side of the insert 9'' bears against that side of the doctor blade 3 which faces away from the exposed side of the web (not shown) on the drum 11. The insert 9'' preferably consists of spring steel.

Figure 3:
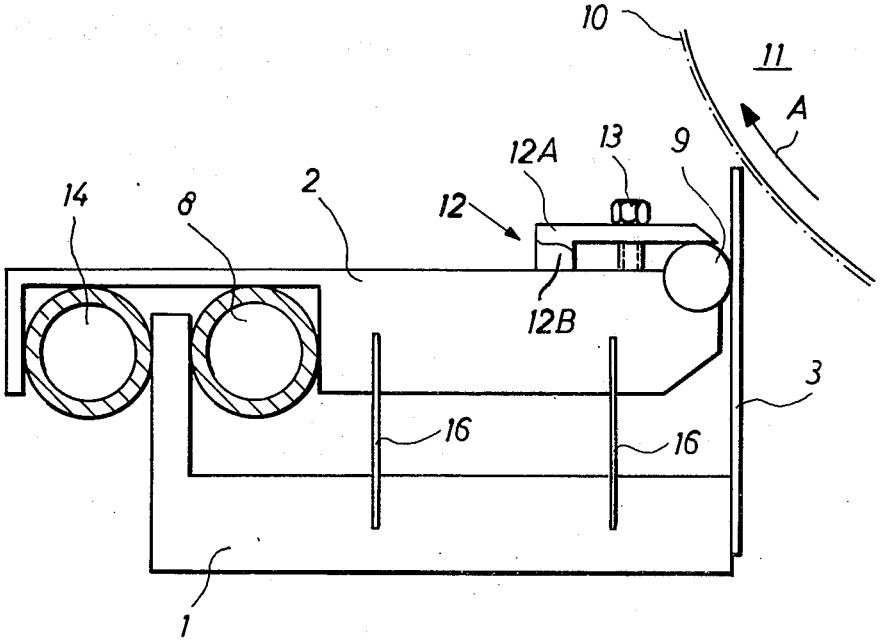
FIG. 3 is a schematic transverse vertical sectional view of a fourth apparatus.

Referring to FIG. 3, there is shown a further apparatus wherein the expansion or contraction of inflatable hose 8 results in substantially translatory movements of the beam 2 toward or away from the doctor blade 3. The leaf spring 4 or 4' is replaced by several leaf springs 16 which are anchored in the beam 2 and in the support 1 and restrict the beam to substantially translatory movement in directions toward or away from the blade 3 in response to rising pressure of fluid which is confined in the hose 8 or 14. More specifically, the beam 2 will move toward the doctor blade 3 when the pressure of fluid in the hose 8 increases and/or when the pressure of fluid in the hose 14 decreases. The beam 8 will move away from the blade 3 when the pressure of fluid in the hose 14 increases and/or the pressure of fluid in the hose 8 decreases.

If the insert 9 is to perform true translatory movements, the leaf springs 16 are replaced by restricting means in the form of a tongue and groove connection between the support 1 and beam 2. For example, the beam 2 can be provided with a downwardly extending rail which is normal to and crosses in space with the axis of the drum 11, and the upper side of the support 1 is then provided with a guide groove for the rail.

FIG. 3 further shows the feature that the deforming member 12 may consist of several sections (including the sections 12A and 12B) each of which is adjustable independently of the other section or sections.

Figure 4:
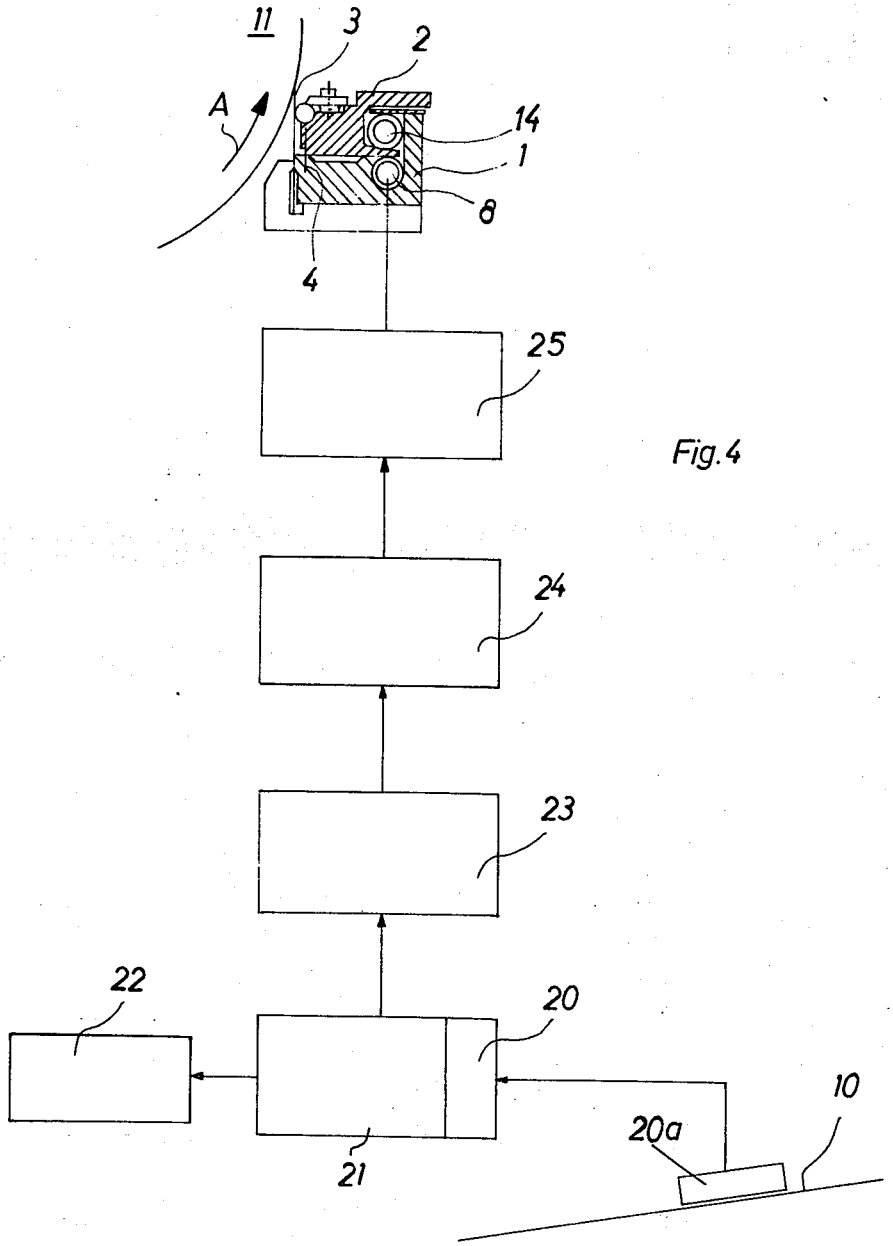
FIG. 4 is a block diagram of means for automatically adjusting the apparatus of FIG. 1 in response to monitoring of the coated surface of a running web.

FIG. 4 shows the apparatus of FIG. 1 in combination with means for automatically regulating the pressure of fluid in the inflatable hose 8. The structure of FIG. 4 includes a device 20 which monitors the weight of coating composition at the exposed side of the web 10 by means of a suitable scanning element 20*a*. Such weight monitoring devices are standard parts of coating machines. The signal at the output of the monitoring device 20 represents the actual weight of the coat and is transmitted to the corresponding input of a computer 21 another input of which is connected with the output of a source 22 of reference signals representing the desired or optimum weight of the coat. The source 22 may constitute or include an adjustable potentiometer. The output of the computer 21 transmits signals (e.g., electrical signals with an intensity in the range between 0 and 20 milliamperes) which represent the difference between the monitored and desired weight of the coat. Such signals are transmitted to a circuit 23 whose output transmits signals at a frequency depending on the intensity of signals which are transmitted by the output of the computer 21. The output of the circuit 23 is connected to the input of an electropneumatic transducer 24 which regulates the pressure of fluid in the hose 8 through the medium of a pneumatic amplifier 25. The circuit 23 effects a desirable damping of adjustment of fluid pressure in the hose 8.

The source 22 of reference signals can transmit signals of unvarying intensity or signals of varying intensity. For example, the input of the source 22 can be connected with a device which monitors the weight of unit areas of the web 10 ahead of the coating machine (such weight may represent the weight of unit areas of uncoated web or the weight of unit areas of a web one side of which is already coated with a suitable compound).

It is clear that the structure of FIG. 4 can be used with equal advantage to regulate the pressure in the inflatable hose 14; the pressure of fluid in the hose 8 is then constant. It is further within the purview of the invention to replace the inflatable hose 8 and/or 14 with a suitable mechanism which is adjustable by a computerized system identical with or analogous to the system of FIG. 4. For example, the mechanism may comprise one or more springs or analogous resilient means and means for adjusting the bias of the spring or springs upon the beam 2. (see FIGS. 5 and 6) Alternatively, the mechanism can comprise one or more eccentrics which are adjustable to thereby move the beam 2 against the opposition of the hose 14 or other suitable means which yieldably opposes the action of means which urges the beam in a direction toward the blade.

The utilization of a computerized system for regulating the pressure in the hose 8 and/or 14 contributes to the quality of coated paper, cardboard or the like as well as to a lower percentage of rejects and to fewer interruptions owing to malfunctioning of the coating machine. Since a modern papermaking plant invariably or almost invariably utilizes computerized data processing equipment, it is not even necessary to purchase a computer solely for the purposes described in connection with FIG. 4. The insert 9 or 9″ can be replaced with a hose which contains a gaseous or hydraulic fluid.

Figure 5:
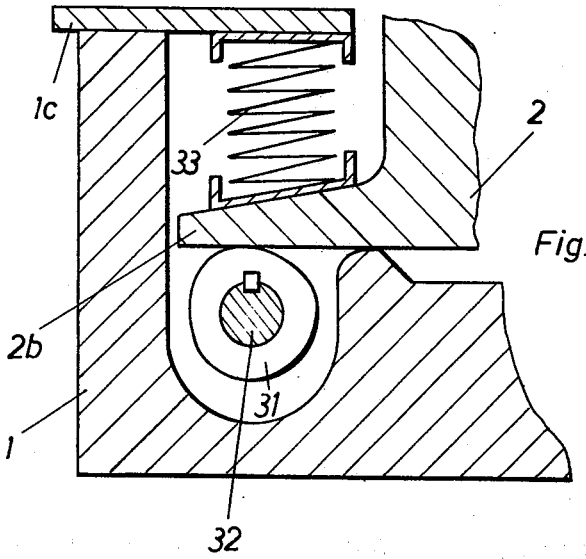
FIG. 5 is a fragmentary transverse vertical sectional view of a further apparatus.

FIG. 5 shows a spring 33 which replaces the inflatable hose 14 of FIG. 1 and whose bias can be adjusted by a cam 31 which replaces the hose 8 and is keyed to a rotary shaft 32.

Figure 6:
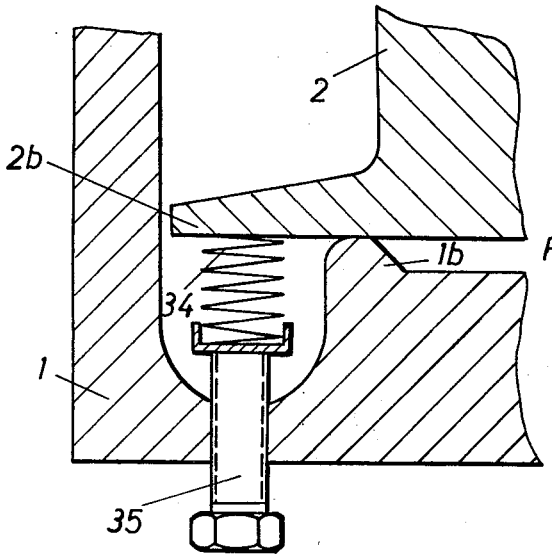
FIG. 6 is a similar sectional view of still another apparatus.

FIG. 6 shows a spring 34 which replaces the hose 8 of FIG. 1 and whose bias can be changed by a bolt 35 meshing with the support 1.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for removing the surplus of coating composition from the coated side of a running web which consists of a paper or the like, comprising means for advancing the web along a predetermined path wherein the coated side of the web is exposed; a deformable doctor blade adjacent to the coated side of the web and extending substantially transversely of said path; means for adjusting the profile of said blade, including a profile determining element which is in direct contact with said blade and means for adjusting said element to thereby vary the profile of said blade; means for biasing said blade to a predetermined position with respect to the exposed side of the web in said path through the medium of said element, including a fixed support for said blade, a rigid member mounting said profile adjusting means, means for movably coupling said rigid member with said support for movement relative thereto, said rigid member extending substantially transversely of and being movable toward and away from said path, and means interposed between said support and said rigid member for urging said rigid member toward said path with a first force; means interposed between said support and said rigid member for urging said member away from said path with a second force so that said blade is biased to said predetermined position with a third force representing the difference between said first and second forces; and means for adjusting at least one of said urging means to thereby vary said third force so that the regulation of the thickness of the coating on the web can be regulated by adjusting said element independently of adjustment of said third force and/or by varying said third force.

2. Apparatus as defined in claim 1, wherein said coupling means comprises means for restricting said member to substantially translatory movement relative to said support.

3. Apparatus as defined in claim 1, wherein said coupling means comprises means for restricting said member to pivotal movement relative to said support.

4. Apparatus as defined in claim 3, wherein said restricting means comprises a device which defines for said member a pivot axis extending transversely of said path in substantial parallelism with said blade.

5. Apparatus as defined in claim 4, wherein said member has a first portion nearer to and a second portion more distant from said blade, said pivot axis being nearer to said first portion and said first mentioned urging means engaging said member in the region of said second portion thereof.

6. Apparatus as defined in claim 5, wherein said pivot axis is disposed intermediate said first and second portions of said member.

7. Apparatus as defined in claim 4, wherein said device comprises a leaf spring having first and second portions and means for respectively securing said first and second portions of said spring to said member and said support.

8. Apparatus as defined in claim 7, wherein said first portion of said member is adjacent said blade and is secured to said first portion of said spring, said support having a portion adjacent said blade and secured to said second portion of said spring, said spring being substantially parallel to said blade.

9. Apparatus as defined in claim 8, wherein said spring is closely adjacent said blade.

10. Apparatus as defined in claim 7, further comprising means for flexing said spring intermediate said first and second portions thereof in response to pivoting of said member, said flexing means comprising a first component provided on said member at one side of said spring and a second component provided on said support at the other side of said spring opposite said first component.

11. Apparatus as defined in claim 10, wherein one of said components is an edge face and the other of said components is a convex surface.

12. Apparatus as defined in claim 1, wherein said profile determining element consists of resilient material and extends lengthwise of said blade transversely of said path, said means for adjusting and element comprising means for deforming selected portions of said element.

13. Apparatus as defined in claim 12, wherein said element has a first portion which abuts against said blade and a second portion which is engaged by said deforming means, said means for adjusting said element further comprising means for changing the position of said deforming means relative to said second portion of said element and for thereby changing the extent of deformation of said first portion of said element with attendant change in the position of said blade.

14. Apparatus as defined in claim 13, wherein said deforming means has a plurality of sections which are adjustable independently of each other to thereby change the extent of deformation of the corresponding parts of said first portion of said element.

15. Apparatus as defined in claim 12, wherein said element consists of rubber or elastomeric synthetic plastic material.

16. Apparatus as defined in claim 15, wherein said element is a rod.

17. Apparatus as defined in claim 16, wherein said rod has a substantially circular profile in undeformed condition of said element.

18. Apparatus as defined in claim 12, wherein said element is a leaf spring.

19. Apparatus as defined in claim 18, wherein said leaf spring has a convex side abutting said blade.

20. Apparatus as defined in claim 18, wherein said spring consists of steel.

21. Apparatus as defined in claim 1, wherein said profile determining element is a fluid-containing hose.

22. Apparatus as defined in claim 1, wherein said means for urging said member toward said path comprises an adjustable mechanism.

23. Apparatus as defined in claim 22, wherein said mechanism comprises resilient means.

24. Apparatus as defined in claim 22, wherein said mechanism comprises an eccentric.

25. Apparatus as defined in claim 1, wherein said means for urging said member toward said path comprises at least one inflatable receptacle for a supply of fluid and said means for adjusting at least one of said urging means comprises means for varying the pressure of fluid in said receptacle.

26. Apparatus as defined in claim 25, wherein said receptacle comprises an elongated flexible hose extending transversely of said path.

27. Apparatus as defined in claim 1, wherein said first mentioned urging means comprises a first inflatable receptacle for a first supply of fluid and said last mentioned urging means comprises a second inflatable receptacle for a second supply of fluid, the difference between the fluid pressures in said first and second receptacles being determinative of said third force.

28. Apparatus as defined in claim 27, wherein said second receptacle comprises an elongated hose extending transversely of said path.

29. Apparatus as defined in claim 27, wherein said means for adjusting at least one of said urging means comprises means for varying the fluid pressure in at least one of said receptacles.

30. Apparatus as defined in claim 1, wherein said means for adjusting at least one of said urging means comprises means for regulating the magnitude of said first force.

31. Apparatus as defined in claim 30, further comprising means for adjusting said regulating means as a function of changes in the weight of coating composition per unit area of the running web.

32. Apparatus as defined in claim 30, wherein said first mentioned urging means comprises at least one fluid-containing hose and said regulating means includes a computer having a signal-transmitting output and means for varying the pressure of fluid in said hose as a function of changes in the characteristics of signals at said output, said pressure varying means comprising an electropneumatic transducer and a pneumatic amplifier.

33. Apparatus as defined in claim 32, further comprising damping means interposed between said output and said transducer.

34. Apparatus as defined in claim 1, wherein said first and last mentioned urging means respectively comprise first and second resilient means, the bias of one of said resilient means upon said rigid member increasing while the bias of the other of said resilient means upon said rigid member decreases and vice versa.

35. Apparatus as defined in claim 34, wherein said support has a first surface and said rigid member has a second surface disposed substantially opposite said first surface, said second resilient means comprising an inflatable hose disposed between said surfaces and extending in substantial parallelism with said blade.

36. Apparatus as defined in claim 34, wherein said second resilient means comprises at least one spring.

* * * * *